US012228371B2

(12) United States Patent
Richter et al.

(10) Patent No.: US 12,228,371 B2
(45) **Date of Patent: *Feb. 18, 2025**

(54) SYSTEMS AND METHODS FOR GENERATING OPTICAL BEAM ARRAYS

(71) Applicant: Wrap Technologies, Inc., Tempe, AZ (US)

(72) Inventors: David T. Richter, Tempe, AZ (US); Milan Cerovic, Tempe, AZ (US)

(73) Assignee: Wrap Technologies, Inc., Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/507,859

(22) Filed: Nov. 13, 2023

(65) Prior Publication Data

US 2024/0288247 A1 Aug. 29, 2024

Related U.S. Application Data

(63) Continuation of application No. 17/535,456, filed on Nov. 24, 2021, now Pat. No. 11,852,439.

(51) Int. Cl.
*F41G 1/35* (2006.01)
*F41H 13/00* (2006.01)

(52) U.S. Cl.
CPC ..... *F41G 1/35* (2013.01); *F41H 13/0006* (2013.01); *F41H 13/0025* (2013.01)

(58) Field of Classification Search
CPC ..... F41H 13/0006; F41H 13/0025; F41G 1/35
USPC ..... 42/115
See application file for complete search history.

(56) References Cited

U.S. PATENT DOCUMENTS

| | | | |
|---|---|---|---|
| 1,217,415 | A | 2/1917 | Colomyjczuk |
| 1,229,421 | A | 6/1917 | Downs |
| 1,276,689 | A | 8/1918 | Poudrier |
| 1,304,857 | A | 5/1919 | Davis |
| 1,343,747 | A | 6/1920 | Radakovich |
| 1,488,182 | A | 3/1924 | Whelton |

(Continued)

FOREIGN PATENT DOCUMENTS

| | | | |
|---|---|---|---|
| CN | 202506124 | U | 10/2012 |
| EP | 0195566 | A2 | 9/1986 |

(Continued)

OTHER PUBLICATIONS

PCT Application No. PCT/US18/56068 Filing Date Oct. 16, 2018 Troy Chambers International Search Report Mailing Date Jan. 15, 2019; 11 pages.

(Continued)

*Primary Examiner* — Samir Abdosh
(74) *Attorney, Agent, or Firm* — Thorpe North & Western; Jason R. Jones

(57) ABSTRACT

A projectile launcher device and associated optical beam generating system includes a body having at least two sockets, each socket carrying a projectile. A power source is capable of expelling each projectile from the launcher into a projectile plane. An optical beam generating system is capable of generating a beam array. The beam array includes at least two distinct pattern beams that divergently extend from the launcher at a non-zero angle relative to one another, and a void region formed between the at least two pattern beams, the void region being devoid of any portion of the optical beam.

18 Claims, 6 Drawing Sheets

(56) References Cited

U.S. PATENT DOCUMENTS 1,536,164 A 5/1925 Tainton
2,354,451 A 7/1944 Forbes
2,372,383 A 3/1945 Lee
2,373,363 A 4/1945 Wellcome
2,373,364 A 4/1945 Wellcome
2,455,784 A 12/1948 Lapsensohn
2,611,340 A 9/1952 Manning
2,668,499 A 2/1954 Mourlaque
2,797,924 A 7/1957 Stewart
3,085,510 A 4/1963 Campbell
3,340,642 A 9/1967 Vasiljevic
3,484,665 A 12/1969 Mountjoy et al.
3,583,087 A 6/1971 Huebner
3,717,348 A 2/1973 Bowers
3,773,026 A 11/1973 Romero
3,803,463 A 4/1974 Cover
3,831,306 A 8/1974 Gregg
3,921,614 A 11/1975 Fogelgren
4,027,418 A 6/1977 Baldi et al.
4,166,619 A 9/1979 Bergmann et al.
4,193,386 A 3/1980 Rossi
4,253,132 A 2/1981 Cover
4,318,389 A 3/1982 Kiss, Jr.
4,466,417 A 8/1984 Mulot et al.
4,559,737 A 12/1985 Washington
4,656,947 A 4/1987 Gordon et al.
4,664,034 A 5/1987 Christian
4,750,692 A 6/1988 Howard
4,752,539 A 6/1988 Vatter
4,912,867 A 4/1990 Dukes, Jr.
4,912,869 A 4/1990 Govett
4,962,747 A 10/1990 Biller
5,003,886 A 4/1991 Pahnke et al.
5,078,117 A 1/1992 Cover
5,103,366 A 4/1992 Battochi
5,145,187 A 9/1992 Lewis
5,197,691 A 3/1993 Amon et al.
5,279,482 A 1/1994 Dzenitis et al.
5,314,196 A 5/1994 Ruelle
5,315,932 A 5/1994 Bertram
5,326,101 A 7/1994 Fay
5,372,118 A 12/1994 Schmidt, III et al.
5,396,830 A 3/1995 Kornblith et al.
5,460,155 A 10/1995 Hobbs, II
5,561,263 A 10/1996 Baillod
5,601,255 A 2/1997 Romer et al.
5,649,466 A 7/1997 Genovese
5,654,867 A 8/1997 Murray
5,698,815 A 12/1997 Ragner
5,706,795 A 1/1998 Gerwig
5,750,918 A 5/1998 Mangolds et al.
5,782,002 A 7/1998 Reed
5,786,546 A 7/1998 Simson
5,814,753 A 9/1998 Rieger
5,831,199 A 11/1998 McNulty, Jr. et al.
5,898,125 A 4/1999 Mangolds et al.
5,904,132 A 5/1999 Biller
5,943,806 A 8/1999 Underwood
5,962,806 A 10/1999 Coakley et al.
5,996,504 A 12/1999 Lowery
6,283,037 B1 9/2001 Sclafani
6,292,304 B1 * 9/2001 Kim ..... G02B 27/09 359/558
6,377,400 B1 4/2002 Hollander
6,381,894 B1 5/2002 Murphy
6,382,071 B1 5/2002 Bertani
6,543,173 B1 4/2003 Golan
6,575,073 B2 6/2003 McNulty, Jr. et al.
6,615,622 B2 9/2003 MacAleese et al.
6,636,412 B2 10/2003 Smith
6,729,222 B2 5/2004 McNulty, Jr.
6,820,560 B1 11/2004 Romppanen
6,880,466 B2 4/2005 Carman
6,898,887 B1 5/2005 Stratbucker
7,042,696 B2 5/2006 Smith et al.
7,065,915 B2 6/2006 Chang
7,114,450 B1 10/2006 Chang
7,143,539 B2 12/2006 Cerovic et al.
7,218,501 B2 5/2007 Keely
7,237,352 B2 7/2007 Keely et al.
7,314,007 B2 1/2008 Su
7,327,549 B2 2/2008 Smith et al.
7,412,975 B2 8/2008 Dillon, Jr.
7,418,016 B2 * 8/2008 Gruhlke ..... G06F 3/0317 359/558
7,444,939 B2 11/2008 McNulty et al.
7,444,940 B2 11/2008 Kapeles et al.
7,640,839 B2 1/2010 McNulty, Jr.
7,640,860 B1 1/2010 Glover et al.
7,673,411 B1 3/2010 Baldwin
7,686,002 B2 3/2010 Andrews
7,778,005 B2 8/2010 Saliga
7,791,858 B2 9/2010 Hummel et al.
7,856,929 B2 12/2010 Gavin et al.
7,859,818 B2 12/2010 Kroll et al.
7,900,388 B2 3/2011 Brundula et al.
7,905,180 B2 3/2011 Chen
7,950,176 B1 5/2011 Nemtyshkin et al.
7,950,329 B1 5/2011 Nemtyshkin et al.
7,984,676 B1 7/2011 Gavin et al.
8,015,905 B2 9/2011 Park
8,024,889 B2 9/2011 Bunker
8,082,199 B2 12/2011 Kwok
8,141,493 B1 3/2012 Kuchman
8,186,276 B1 5/2012 Olden et al.
8,231,474 B2 7/2012 Stethem
8,261,666 B2 9/2012 Garg
8,281,776 B2 10/2012 Körver et al.
8,339,763 B2 12/2012 McNulty, Jr.
8,441,771 B2 5/2013 Hinz et al.
8,601,928 B2 12/2013 Martinez et al.
8,671,841 B2 3/2014 Raquin et al.
8,677,675 B2 3/2014 Koch
8,695,578 B2 4/2014 Olden et al.
8,857,305 B1 10/2014 Tseng
8,896,982 B2 11/2014 Beechey et al.
8,899,139 B2 12/2014 Brill et al.
9,025,304 B2 5/2015 Brundula et al.
9,157,694 B1 10/2015 Tseng
9,220,246 B1 12/2015 Roman
9,255,765 B2 2/2016 Nelson
9,303,942 B2 4/2016 Sievers
9,335,119 B2 5/2016 Werner
9,414,578 B2 8/2016 Thornbrough
9,638,498 B2 5/2017 Chang
10,107,599 B2 10/2018 Norris et al.
2002/0134365 A1 9/2002 Gray
2002/0170418 A1 11/2002 McNulty, Jr. et al.
2003/0165041 A1 9/2003 Stethem
2003/0165042 A1 9/2003 Stethem
2004/0245338 A1 12/2004 Poloniewicz
2005/0166441 A1 8/2005 Mattox
2005/0185694 A1 8/2005 Hollander
2006/0033995 A1 * 2/2006 Smith ..... G02F 1/292 359/558
2006/0112574 A1 6/2006 Hodge et al.
2007/0019358 A1 1/2007 Kroll
2007/0101893 A1 5/2007 Shalev et al.
2007/0264079 A1 11/2007 Martinez et al.
2007/0273957 A1 * 11/2007 Zalevsky ..... G02B 19/0014 359/566
2009/0009838 A1 * 1/2009 Masuda ..... G02B 27/4294 359/558
2009/0084284 A1 4/2009 Martinez et al.
2010/0126483 A1 5/2010 Makowski
2010/0195697 A1 8/2010 Hollander et al.
2010/0315756 A1 12/2010 Gavin
2011/0005373 A1 1/2011 Martinez et al.
2011/0271825 A1 11/2011 Howland
2012/0019975 A1 1/2012 Hanchett et al.
2012/0210904 A1 8/2012 Merems
2013/0208392 A1 8/2013 Brundula et al.
2014/0168774 A1 * 6/2014 Zhao ..... G01N 21/9501 359/566

(56) References Cited

U.S. PATENT DOCUMENTS

| | | | | |
|---|---|---|---|---|
| 2014/0307307 | A1* | 10/2014 | Georgiou | H04N 13/254 359/558 |
| 2014/0331984 | A1 | 11/2014 | Brahler, II et al. | |
| 2014/0334058 | A1 | 11/2014 | Galvan et al. | |
| 2015/0075073 | A1 | 3/2015 | Sylvester | |
| 2015/0168107 | A1 | 6/2015 | Tseng | |
| 2015/0241180 | A1 | 8/2015 | Pruett | |
| 2015/0276351 | A1 | 10/2015 | Teetzel et al. | |
| 2015/0316345 | A1 | 11/2015 | Brahler, II et al. | |
| 2015/0371434 | A1* | 12/2015 | Nash | G02B 27/4266 359/558 |
| 2016/0010949 | A1 | 1/2016 | Teetzel et al. | |
| 2016/0161225 | A1 | 6/2016 | Searle et al. | |
| 2016/0238350 | A1 | 8/2016 | Tseng | |
| 2016/0377414 | A1* | 12/2016 | Thuries | G02B 27/1093 359/558 |
| 2017/0160060 | A1 | 6/2017 | Purvis | |
| 2017/0241751 | A1 | 8/2017 | Nerheim | |
| 2017/0276461 | A1 | 9/2017 | Norris et al. | |
| 2018/0003462 | A1 | 1/2018 | Chavez | |
| 2018/0292172 | A1 | 10/2018 | Ehrlich | |
| 2020/0050012 | A1 | 2/2020 | Vonmetz et al. | |
| 2021/0156651 | A1 | 5/2021 | Norris | |

FOREIGN PATENT DOCUMENTS

| | | | |
|---|---|---|---|
| TW | 200632274 | A | 9/2006 |
| TW | 201226868 | A | 7/2012 |
| WO | WO 2019/136854 | A1 | 7/2019 |

OTHER PUBLICATIONS

PCT Application No. PCT/US2022/045809 Filing Date Oct. 5, 2022 International Search Report Mailing Date Jan. 6, 2023; 12 Pages.

* cited by examiner

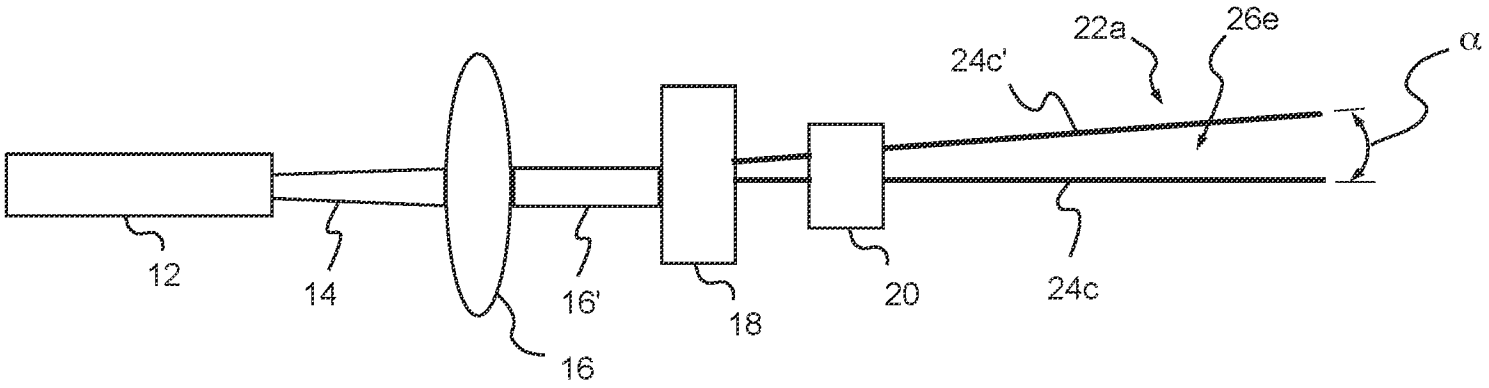
FIG. 3A
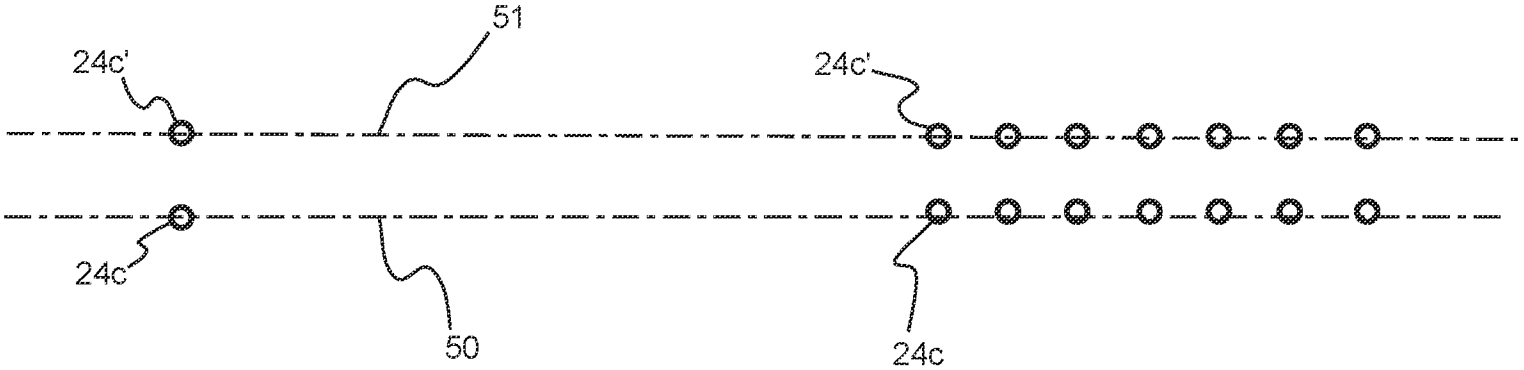
FIG. 3B
FIG. 3C

SYSTEMS AND METHODS FOR GENERATING OPTICAL BEAM ARRAYS

PRIORITY CLAIM

This is a continuation of U.S. patent application Ser. No. 17/535,456, filed Nov. 24, 2021, which is hereby incorporated herein by reference in its entirety.

BACKGROUND OF THE INVENTION

Field of the Invention

The present invention relates generally to systems for generating optical beam arrays for use in aiming projectile launchers and the like.

Related Art

Optical laser sights are often used with projectile launchers to aid a user in properly aiming the launcher. A laser sight is a small, usually visible-light laser placed on a launcher and aligned to emit a beam parallel to a normal direction of aim of the launcher. Since a laser beam generally has low divergence, the laser light appears as a small dot or spot, even at long distances; the user places the spot on the desired target and the launcher is thereby aligned at the location at which the laser sight is directed.

While such laser sights have proved popular to some degree, there remain applications in which the projected aiming location is difficult for a user to see clearly. Accordingly, efforts continue to provide clearly visible, safe and effective optical laser sights.

SUMMARY OF THE INVENTION

In accordance with one aspect of the invention, a system for generating an optical beam array for use with a projectile launcher is provided, the system including a projectile launcher carrying at least two projectiles dischargeable from the launcher. At least one laser light source can be carried by the projectile launcher to generate a beam array extendable from the projectile launcher. The beam array can include at least two distinct pattern beams that divergently extend from the projectile launcher at a non-zero angle relative to one another. A void region can be formed between the at least two pattern beams, the void region being devoid of any portion of the at least one laser light source.

In accordance with another aspect of the technology, a projectile launcher device is provided, including a body having at least two sockets, each socket carrying a projectile. A power source can be capable of expelling each projectile from the launcher into a projectile plane. An optical beam generating system can be capable of generating a beam array. The beam array can include at least two distinct pattern beams that divergently extend from the launcher at a non-zero angle relative to one another. A void region can be formed between the at least two pattern beams, the void region being devoid of any portion of the optical beam.

In accordance with another aspect of the technology, a projectile launcher device is provided, including a body including at least two sockets, each socket carrying a projectile. A power source can be capable of expelling each projectile from the launcher into a projectile plane. An optical beam generating system can be capable of generating a beam array. The beam array can include seven distinct pattern beams that divergently extend from the body at a non-zero angle relative to one another. A void region can be formed between the at least two pattern beams, the void region being devoid of any portion of the optical beam.

BRIEF DESCRIPTION OF THE DRAWINGS

The following drawings illustrate exemplary embodiments for carrying out the invention. Like reference numerals refer to like parts in different views or embodiments of the present invention in the drawings.

FIG. 3A is a side view of an optical beam generating system in accordance with another aspect of the technology;

FIG. 3B is a schematic representation of a side view of a target pattern formed by the optical beam generating system of FIG. 3A;

FIG. 3C is a schematic representation of a front or rear view of the target pattern formed by the optical beam generating system of FIG. 3A;

DETAILED DESCRIPTION

Figure 1A:
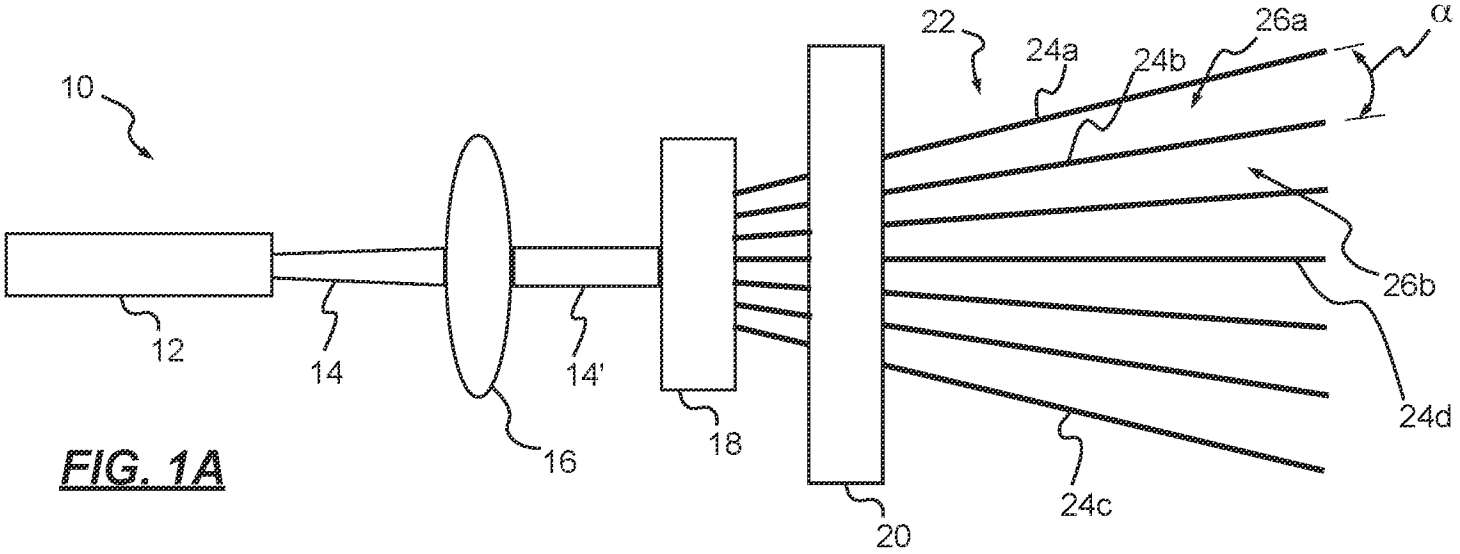
FIG. 1A is a schematic top view of an optical beam generating system in accordance with an aspect of the technology.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to a "beam" can include one or more of such beams, if the context dictates.

As used herein, the term "launcher" refers to any of a variety of devices capable of launching, propelling or otherwise discharging a projectile. Suitable examples of launchers are discussed in previous patent applications to the present Applicant, including without limitation U.S. patent application Ser. No. 15/467,958, filed Mar. 23, 2017. Other suitable launchers include, without limitation, conventional firearms, EMD (electro-muscular discharge) weapons, and various short- and long-range non-lethal weapons.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "lower," "higher," "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present technology relates generally to systems for providing optical sighting aids for projectile launchers of varying types. The technology provides a manner by which an array of light beams can be generated to provide a targeting pattern upon a desired surface. The technology maximizes the visibility of each of the light beams while minimizing the potential for injury to the human eye as a result of exposure to one of more of the beams. While the present technology can be used in a variety of applications, it is well suited for use with relatively short-range launchers that may be aimed at irregular or moving objects or surfaces.

Figure 1B:
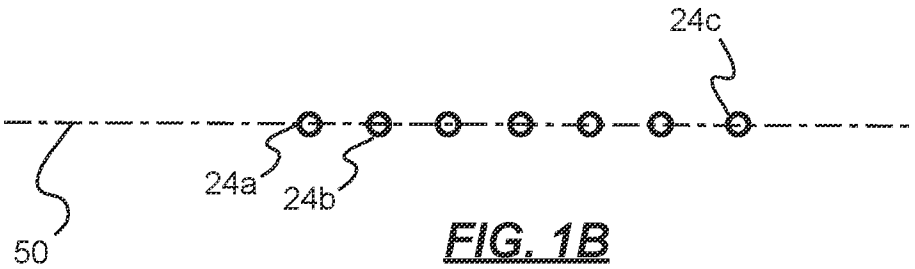
FIG. 1B is a schematic representation of a front or rear view of a target pattern formed by the optical beam generating system of FIG. 1A.
Figures 2A, 2B:
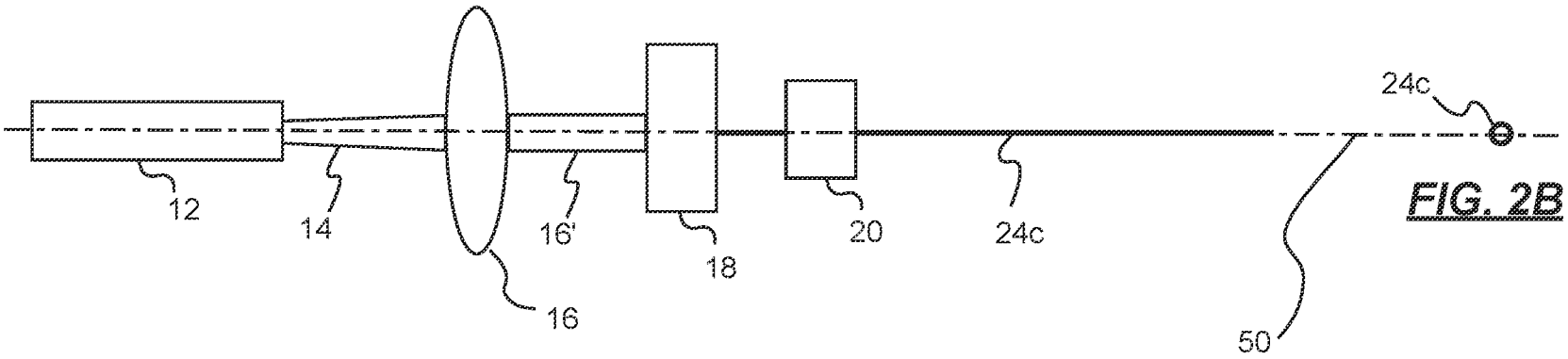
FIG. 2A is a schematic side view of the optical beam generating system of FIG. 1A.
FIG. 2B is a schematic representation of a side view of the target pattern formed by the optical beam generating system of FIG. 2A.

Shown generally in FIG. 1, in one aspect of the invention, a system 10 is provided for generating an optical beam array that can be directed toward a variety of subjects to generate a beam pattern on the subject. The system can include a laser light source 12 capable of generating a primary beam of light 14. Optionally, a collimator 16 can be provided to collimate the primary beam of light to create a columnar primary beam 14'. An array generating optical element 18 can be capable of receiving the primary beam of light 14 (with no collimator present), or 14' after collimation, and splitting the primary beam of light into a beam array 22. The beam array can pass through a protective, transparent cover 20.

The beam array can include at least two distinct pattern beams that divergently extend from the array generating optical element at a non-zero angle relative to one another. In the example shown, a total of seven distinct pattern beams are shown, 24*a*, 24*b*, 24*c*, etc. Each of the pattern beams can diverge relative to any other pattern beam by an angle of at least "α." A void region (shown generally at 26*a*, 26*b*, etc.) can be formed between the at least two pattern beams. The void region can be devoid of any portion of the primary beam. As the pattern beams are discrete beams that are generally non-dispersive (at least within the size of environments within which the present systems will be utilized), portions of the primary beam are only passed through the array generating optical element in those areas in which a beam is to be formed. In the remainder of the areas, the primary beam is not transmitted, and thus the void region does not contain any laser light transmitted from the optical element.

As used herein, the term "pattern beam" is to be understood to refer to a distinct, individual beam extending from the array generating optical element 18 or DOE. For purposes of the present disclosure, it is to be understood that each of the pattern beams generated are generated intentionally, and thus that any portion of the beam array 22, 22' that are illustrated or discussed as not possessing a pattern beam intentionally possess instead a void region. In other words, the void regions discussed and shown are intentionally generated as a positive portion of the beam array.

The present system can be carefully configured to both maximize the brightness of each pattern beam generated and to minimize the risk of any dangerous eye exposure to dangerous levels of laser light. In the example shown in FIGS. 1A through 2B, the laser source 12 can be capable of generating a 35 milliwatt ("mW") primary beam. As this beam is dispersed into the beam array 22, each pattern beam can thus have a maximum power of about 5 mW, which is in most jurisdictions considered safe for exposure to the human eye. As each of the beams diverge from one another after leaving the optical element 18, the collective exposure a user or third party experiences will not exceed the recommended total exposure. By carefully controlling the angle "a," the present technology can provide a beam array that is sufficiently bright to be visible even in daylight conditions, yet is safe for use due to the physical arrangement of the pattern beams.

The angle "α" can vary depending on a number of design conditions. In one aspect, however, the angle between the at least two pattern beams 24*a*, 24*b*, etc., is between about 0.5 degrees and about 5 degrees. In another example, the angle is between about 0.5 degrees and about 1 degree. In another example, the angle is about 0.75 degrees.

The varying light-generating and optical components can be of a number of designs generally known in the art. The array generating optical element 18 can, for example, be a Diffractive Optical Element ("DOE"), which can be obtained commercially with design specifications provided by the Applicant to produce the beam array disclosed. As is known in the art, DOEs are manufactured to have microstructure patterns that alter and control the phase of transmitted laser light. By altering the microstructures, it is possible for the present DOE to produce the beam array disclosed herein. Examples of these types of optical elements can be manufactured from various substrates, including plastic, fused silica, germanium, sapphire, and zinc selenide (ZnSe), and the like. These types of optical elements can be used with visible, UV (ultraviolet) and infrared (IR) lasers.

The laser light source 12 can similarly be of a variety of types known in the art. In one nonlimiting embodiment, the laser is a Class 3 laser with a wavelength of about 510-530 nm (nanometers), which produces a visible (when projected onto a surface) green beam pattern. The laser can operate at around 3 volts, with a current of 150 mA (milliamps). A maximum operating current can be 230 mA, with an operating temperature range of between about-10 to 60 degrees Celsius. These figures are provided as examples only: a variety of other configurations can be used to accomplish the beam array disclosed herein. For example, red, blue or violet lasers can also be utilized, at varying power levels. The present technology allows the use of varying types and powers of lasers while still providing an easily visible and safe beam array.

Varying the number and configuration of pattern beams 24*a*, 24*b*, etc., and the angle "α" are two manners by which the present technology can compensate for varying laser types and power levels. In one example, the beam array 22 can include at least three distinct pattern beams 24*a*, 24*b*, etc., that each divergently extend from the optical element at a non-zero angle relative to one another. In another example, shown in FIGS. 1A through 2B and 6 through 8, the beam array includes seven distinct pattern beams that each divergently extend from the optical element at a non-zero angle relative to one another. In these embodiments, all of the pattern beams are disposed on a common plane, referenced herein as a pattern plane, shown by example in FIGS. 1B and 2B at 50. This can prove advantageous in applications where the beam array is utilized with a projectile launcher that launchers a plurality of projectiles.

FIGS. 4 through 7 illustrate one such exemplary projectile launcher 40. This launcher is similar in operation to others produced by the present applicant, earlier models being available under the trademark BolaWrap® launchers. One exemplary configuration of a cassette 42 for use with this type of launcher is shown schematically in FIG. 5. It is noted that this view is intended only to illustrate the operation of the launcher and projectiles and is not necessarily a representation of the dimensions, components or structure used in the launcher shown. In this non-limiting example, the cassette includes a pair of sockets 44*a*, 44*b*, in each of which a projectile 46*a*, 46*b*, respectively, can be carried. A pair of power sources 48*a*, 48*b*, can be associated with each socket (alternatively, only a single power source can be utilized). Activation of the power sources causes a high pressure wave to expel or discharge the projectiles from the cassette, and thus from the launcher. A protective cover 49 (FIG. 4) can remain in position ahead of the projectiles until deployment.

Figure 5:
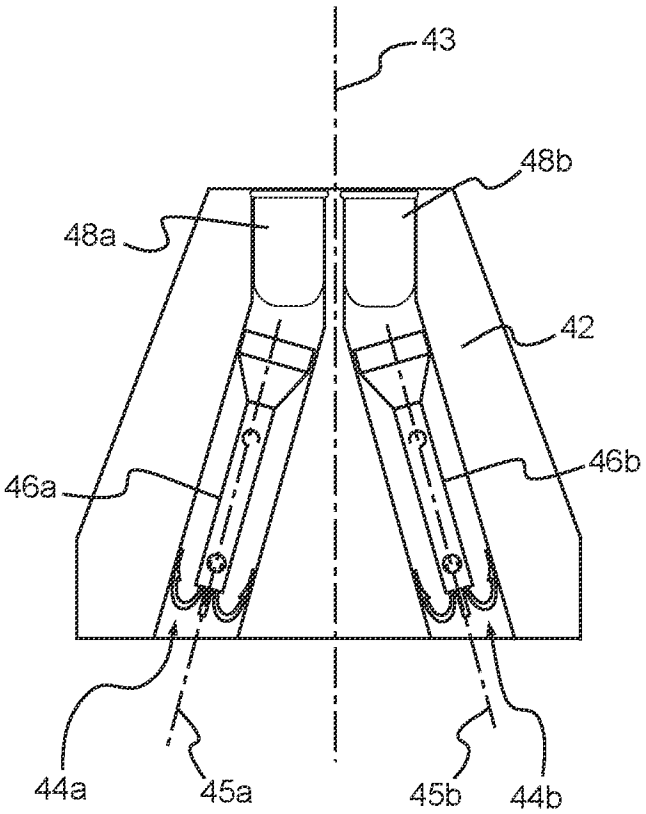
FIG. 5 is a top view an exemplary cassette or internal portion of the launcher of FIG. 4, showing a pair of sockets each carrying one of a pair of projectiles in accordance with an aspect of the technology.
Figure 4:
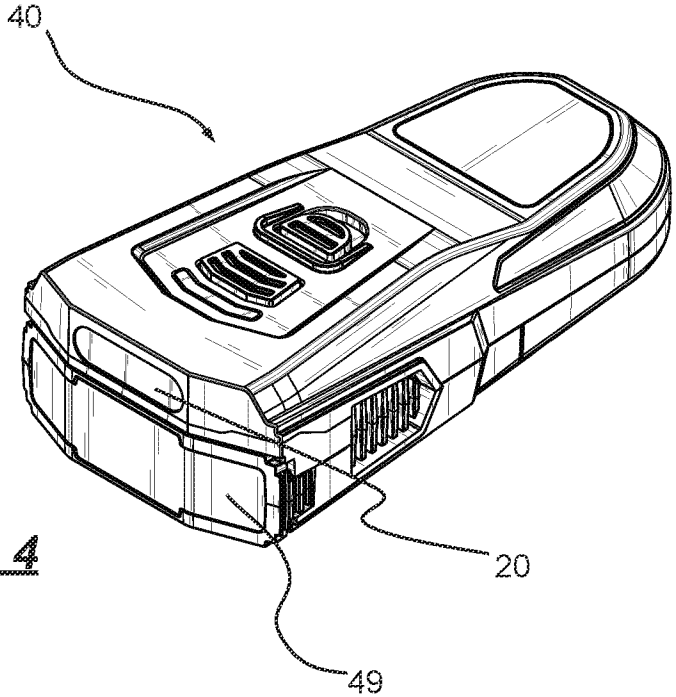
FIG. 4 is a perspective view of an exemplary projectile launcher in accordance with an aspect of the technology.
Figure 8:
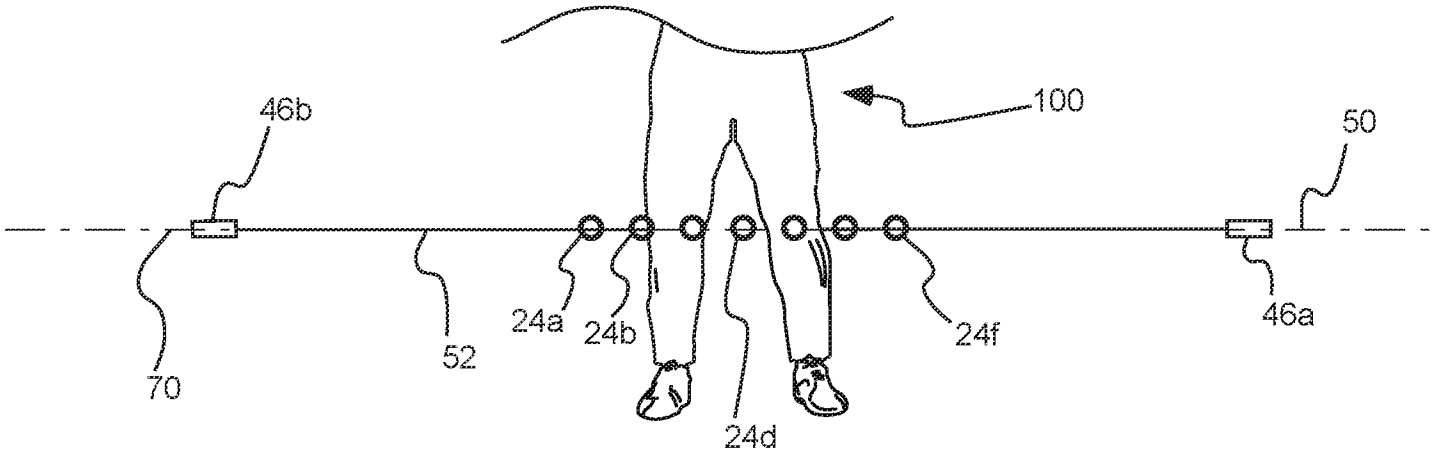
FIG. 8 is a front or rear view of an exemplary implementation of a launcher directing a beam pattern toward a subject in accordance with an aspect of the technology, shown after the launcher has directed a pair of projectiles toward the subject.

While not shown in detail in FIG. 5, a tether can connect the two projectiles 46*a*, 46*b*. Once projected from the launcher, the projectiles diverge from one another, pulling the tether taught between them. The resulting arrangement is shown in FIG. 8, where tether 52 is pulled taught between projectiles 46*a*, 46*b*. The projectiles, once deployed from the launcher, extend into a projectile plane, shown at 70 in FIG. 8. The present technology is well suited for use with such launchers, as such launchers do not launch projectiles toward a single point, but rather along a plane. As will be appreciated from FIG. 8, in this embodiment, the projectile plane 70 is shown coinciding with (or is coplanar with) the pattern plane 50. Stated generally, the components can be configured such that pattern plane 50 is parallel with projectile plane 70, in at least one of three axes of rotation. In other words, even if the respective planes diverge or angle away from or toward one another, when projected onto a surface, a line of intersection of the pattern plane will be visible as being parallel to a line of intersection of the projectile plane.

As that terminology is used herein, two planes that are coincident or coplanar are considered parallel. It will be appreciated that even in the case where the pattern plane 50 might be slightly higher or lower than the projectile plane 70 (the two being parallel on at least one of three axes of rotation), the present system provides an accurate aiming location for the launcher, as the pattern beams can easily be positioned on the subject 100 where impact by the tether is desired.

The present technology thus provides a manner by which a user of launcher 40 can easily orient the launcher toward subject 100 in FIG. 8 and visibly discern the beam array 22 that is thereby projected on the subject. The discrete pattern beams 24*a*, 24*b*, 24*c*, etc., once resolved upon the subject and/or the surrounding environment, provide a highly visible manner by which the user can orient the launcher prior to initiating the launcher. The resulting pattern is easily visible to the user, even in bright daylight, the most challenging environment in which a user must visualize the beam array.

Figure 6:
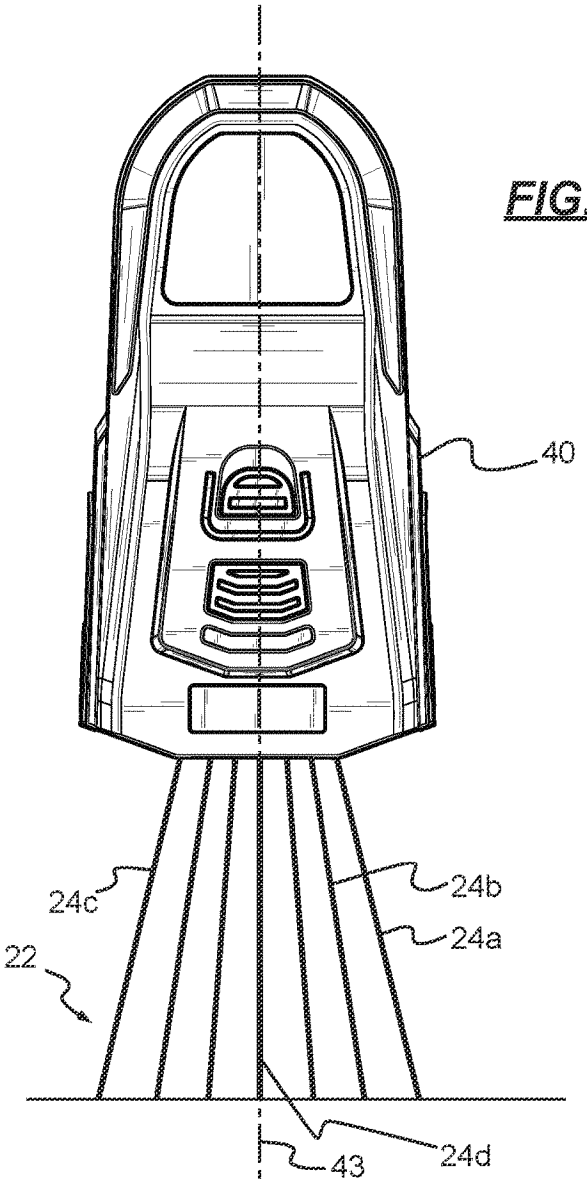
FIG. 6 is a top view of the launcher of FIG. 4, showing a beam pattern generated by an optical beam generating system carried by the launcher.
Figure 7:
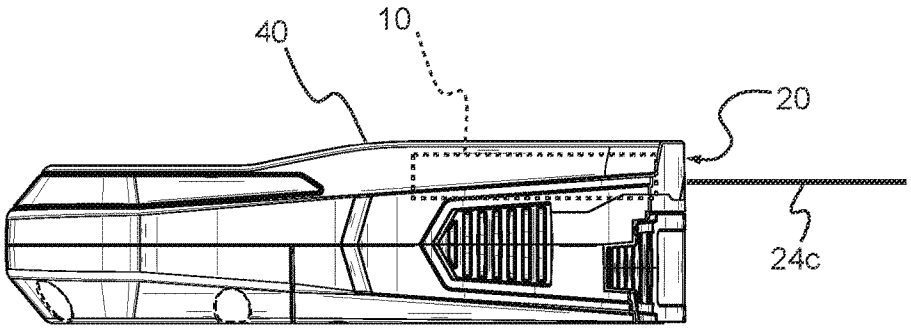
FIG. 7 is a side view of the launcher of FIG. 6.

In one aspect of the technology, the pattern beams 24*a*, 24*b*, 24*c*, etc., diverge from the launcher 40 substantially symmetrically about a centerline of the launcher. As seen in FIGS. 5 and 6, launcher 40 and cassette 42 can include a centerline 43 that corresponds to a forward direction of aim of the launcher. As shown in FIG. 5, the sockets 44*a*, 44*b* of cassette 42 diverge substantially symmetrically from centerline 43. That is, each socket is angled from the centerline at about the same angle. Thus, assuming the centerline is directed toward the center of the subject 100, the projectiles 46*a*, 46*b* will extend equidistance to the sides of the subjects.

In addition, the beam array 22 can be carried by the launcher 40 such that the pattern beams 24*a*, 24*b*, etc., diverge from the launcher symmetrically about the centerline 43. Thus, as shown for example in FIG. 6, the beam array can include a center pattern beam 24*d* that extends from the launcher substantially parallel with the centerline 43 of the launcher. The remaining pattern beams diverge symmetrically relative to each of the pattern beam 24*d* and the centerline 43. In this manner, both the beam array 22 and the projectiles 46*a*, 46*b* (once deployed from the launcher) extend outward from the launcher in a two-dimensional, conic section pattern, with the conic section pattern centered on the centerline 43.

This aspect of the technology advantageously generally projects the pattern beams through the space through which the projectiles will travel. If projected on a surface very near the launcher, the beam array will appear on the surface with very little spread of the patterns beams (the pattern beams will appear very close together). This corresponds generally with the very little spread that the projectiles will experience near the launcher after being expelled from the launcher. When the launcher and the surface are positioned further away from one another, the beam array will appear on the surface with much more spread between the pattern beams: this corresponds to the spread that the projectiles will experience. Thus, a user can obtain an approximation of spread of the projectiles based on spread of the pattern beams.

In addition, as the pattern beams and projectiles traverse in the same general two dimensional, conic section pattern, the pattern beams will illuminate an object that lies between the launcher and the intended target location. For example, if an unintended person or object is positioned in the field of fire of the projectiles, the pattern beams will impinge upon and illuminate that unintended person or object and thereby alert the user that the projectiles do not have a clear line of travel to the intended subject. By correlating the shape of the beam array with the shape of travel of the projectiles, the beam array provides a visual indication of the pattern of travel of the projectiles prior to discharging the projectiles from the launcher. This can also be helpful in situations in which objects or persons near (slightly aside or behind) the subject may be contacted by one of the projectiles if the launcher is initiated.

In one aspect of the technology, the beam array includes a two-dimensional spray pattern having pattern beams lying on a common plane. The projectiles, once deployed from the launcher, travel along an analogous two-dimensional spray pattern with each projectile lying on a common plane. The spray patterns can be conic sections. The common planes can be parallel to one another on at least one of three axes of rotation.

In the embodiment illustrated in FIGS. 3A through 3C, a system is provided in which a beam array 22*a* includes at least two rows of distinct pattern beams that are parallel to one another in at least one of three axes of rotation. As in earlier embodiments, pattern beams on each row can divergently extend from optical element 18*a* at a non-zero angle relative to one another (e.g., if viewed from the top, analogous to FIG. 1A, the beams would diverge at angle "α"). In addition, each of the at least two rows of pattern beams divergently extend from the optical element at a non-zero angle relative to the other row of pattern beams. That is, as viewed from the side in FIG. 3B, the two rows of pattern beams diverge from one another at angle "α." Similarly, a void region 26*e* can be formed between the at least two rows of pattern beams, the void region being devoid of any portion of the primary beam. Thus, in this embodiment, no two pattern beams are generated that do not diverge relative to one another by at least an angle "α." While not so required, each of the two rows of pattern beams can include the same number of pattern beams arranged in substantially the same orientation. In other words, each of the two rows of pattern beams can be identical, but for their varying elevation relative to one another.

It is noted that, while the various optical beams are illustrated herein as visible lines, it is likely the case that the beams are not visible to the naked eye until they impinge on a surface. In other words, the beams shown in FIG. 1A may not be visible to the naked eye, but the pattern shown in FIG. 1B will be visible once the pattern beams contact a surface. In addition, the spacing of the pattern beams provided may vary from those shown by example in figures. They may initially exit the DOE closer together than shown, then diverge from that point forward. Also, the DOE may be closer or further than shown from the protective cover (which would alter the degree of divergence, if any, that has occurred prior to the pattern beams exiting the launcher).

In addition, when lasers having wavelengths outside the visible range are utilized, the pattern beams (or the pattern they create on a surface) may not be visible to the naked eye. A user may need to wear specialized optical gear, such as night vision gear, to view such beam patterns.

In addition, it is noted that the drawings are presented to most clearly explain the various embodiments of the technology. Not all components are shown to scale in the drawings. For example, the pattern "dots" presented in FIGS. 1B, 2B, 3B, 3C and 8 are merely to illustrate the concepts presented. The "dots" are not drawn to scale, and the actual point of contact of a pattern beam on a surface may appear different. For example, instead of round dots or circles, the pattern beams may create a small "x," circle, cross, or other hash mark that clearly indicates the impingement of a beam on a surface.

In addition to the structure outlined above, the present technology also provides various methods of configuring beam generating systems, methods of utilizing such systems, methods of associating such systems with various projectile launchers, and methods of utilizing projectile launchers carrying such systems.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

We claim:

1. A system for generating an optical beam array for use with a projectile launcher, the system comprising:

a projectile launcher carrying at least two projectiles dischargeable from the launcher;

at least one laser light source carried by the projectile launcher to generate a beam array extendable from the projectile launcher;

the beam array including:

at least two distinct pattern beams that divergently extend from the projectile launcher at an angle of between 0.5 and 5 degrees relative to one another; and a void region formed between the at least two pattern beams, the void region being devoid of any portion of the at least one laser light source.

2. The system of claim 1, wherein the angle between the at least two pattern beams is 0.75 degrees.

3. The system of claim 1, further comprising an array generating optical element capable of receiving a primary beam of light generated by the at least one laser light source and splitting the primary beam of light into at least a portion of the beam array.

4. The system of claim 3, wherein the array generating optical element is a Diffractive Optical Element ("DOE").

5. The system of claim 4, further comprising a collimator disposed optically between the laser light source and the DOE.

6. The system of claim 1, wherein the beam array includes at least three distinct pattern beams that each divergently extend from the launcher at an angle of between 0.5 and 5 degrees relative to one another.

7. The system of claim 6, wherein the beam array includes seven distinct pattern beams that each divergently extend from the launcher at an angle of between 0.5 and 5 degrees relative to one another.

8. The system of claim 6, wherein the at least three pattern beams are disposed on a common pattern plane.

9. The system of claim 8, wherein the pattern plane is substantially parallel with a projectile plane of the launcher in at least one of three axes of rotation.

10. The system of claim 1, wherein the beam array includes:

at least two rows of distinct pattern beams that are parallel to one another in at least one of three axes of rotation, pattern beams on each row divergently extending from the optical element at an angle of between 0.5 and 5 degrees relative to one another, and each of the at least two rows of pattern beams divergently extending from the optical element at a non-zero angle relative to the other row of pattern beams, with a void region formed between the at least two rows of pattern beams, the void region being devoid of any portion of the primary beam.

11. The system of claim 10, wherein each of the at least two rows of pattern beams includes the same number of pattern beams.

12. A projectile launcher device, comprising:

a body including at least two sockets, each socket carrying a projectile;

a power source, capable of expelling each projectile from the launcher into a projectile plane; and an optical beam generating system capable of generating a beam array, the beam array including:

at least two distinct pattern beams that divergently extend from the launcher at a non-zero angle relative to one another, the at least two pattern beams being disposed on a common pattern plane; and a void region formed between the at least two pattern beams, the void region being devoid of any portion of the optical beam.

13. The device of claim 12, wherein the optical beam generating system further comprises:

a laser light source capable of generating a primary beam of light; and an array generating optical element capable of receiving the primary beam of light and splitting the primary beam of light into the beam array.

14. The device of claim 13, wherein the array generating optical element is arranged such that the pattern plane is substantially parallel with a projectile plane of the launcher on at least one of three axes of rotation.

15. The device of claim 12, wherein the angle between the at least two pattern beams is between 0.5 degrees and 5 degrees.

16. The device of claim 14, wherein the angle between the at least two pattern beams is 0.75 degrees.

17. The device of claim 12, wherein the beam array includes seven distinct pattern beams that each divergently extend from the launcher at a non-zero angle relative to one another.

18. A projectile launcher device, comprising:

a body including at least two sockets, each socket carrying a projectile;

a power source, capable of expelling each projectile from the launcher into a projectile plane; and an optical beam generating system capable of generating a beam array, the beam array including:

seven distinct pattern beams that divergently extend from the body at an angle of between 0.5 and 5 degrees relative to one another; and a void region formed between the at least two pattern beams, the void region being devoid of any portion of the optical beam.

* * * * *